United States Patent [19]

Lai

[11] Patent Number: 4,744,015

[45] Date of Patent: May 10, 1988

[54] MAT-TYPE ENTRANCE LAMP

[76] Inventor: Aling Lai, 7F-1, No. 11, Lane 233, Min Chuan Rd., Taichung, Taiwan

[21] Appl. No.: 77,144

[22] Filed: Jul. 21, 1987

[51] Int. Cl.[4] ..... F21S 1/14

[52] U.S. Cl. ..... 362/153; 200/86 R; 362/234

[58] Field of Search ..... 362/145, 153, 234, 253; 15/215; 200/86 R

[56] References Cited

U.S. PATENT DOCUMENTS

| | | | |
|---|---|---|---|
| 1,334,805 | 3/1920 | Sherman | 200/86 R |
| 1,355,573 | 10/1920 | Rundback | 200/86 K |
| 1,391,591 | 9/1921 | Stevens | 200/86 R |
| 1,411,167 | 3/1922 | Cutshall | 200/86 R |
| 1,438,592 | 12/1922 | Fraser | 200/86 R |
| 1,494,656 | 5/1924 | Wherland | 200/86 K |
| 1,558,538 | 10/1925 | Fick et al. | 200/86 R |

*Primary Examiner*—Martin P. Schwadron
*Assistant Examiner*—Sue Hagarman
*Attorney, Agent, or Firm*—Varndell Legal Group

[57] ABSTRACT

This invention relates to a mat-type entrance lamp to be placed before the front door or gate to facilitate a person to unlock the door or gate in the dark. The lamp comprises a lamp base, a mat member and a switch platform. The lamp base has two through holes and a battery room for batteries to supply energy to the lamp. The mat member has two posts with bulbs to fit in the said through holes, and a recess with a contact projection and three rubber supports which are higher than the projection . The switch platform is sized to fit in the said recess and has a contact plate on the bottom side. The batteries, bulbs and contact plates are connected with cords in such way that when a person stands on the platform, they will make an electric circuit and the lamp will go on.

1 Claim, 2 Drawing Sheets

MAT-TYPE ENTRANCE LAMP

BACKGROUND AND SUMMARY OF THE INVENTION

Almost all gates and front doors of modern buildings have electric lamps but the lamps have to be installed when they are constructed. It takes trouble to install electric lamps on old houses and the work must be done by an electrician. The installation is to cause damage to the wall or door frame and prejudice the appearance. Furthermore, the electric lamps do not work during electric failure.

To eliminate these disadvantages, this invention is developed. So the main object of this invention is to provide a mat-type entrance lamp which is as easy to install as placing a doormat before the front door.

Another object of this invention is to provide a mat-type entrance lamp which is powered by batteries and is not affected by power failure.

Still another object of this invention is to provide a mat-type entrance lamp which can be used as a doormate to wipe mud and dirt from the shoes.

DETAILED DESCRIPTION OF THE PREFERRED EMBODIMENT

Figure 1:
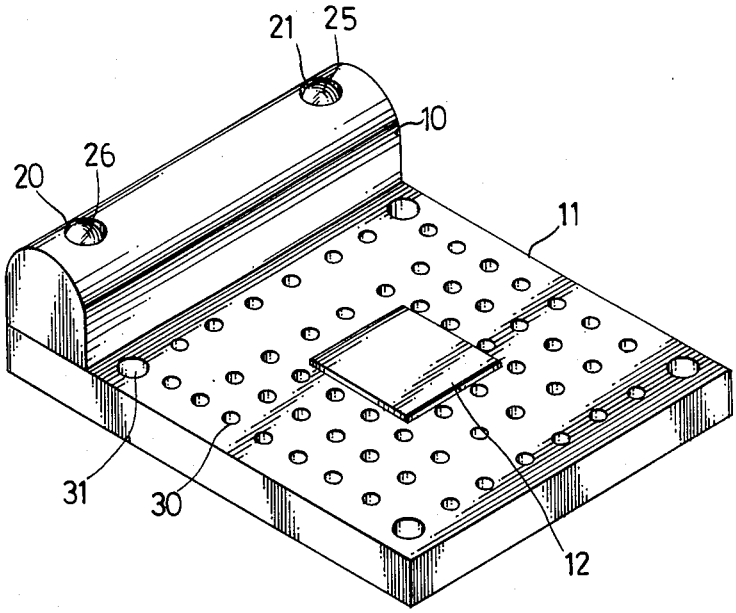
FIG. 1 is a vertical view of the mat-type entrance lamp of this invention.
Figure 2:
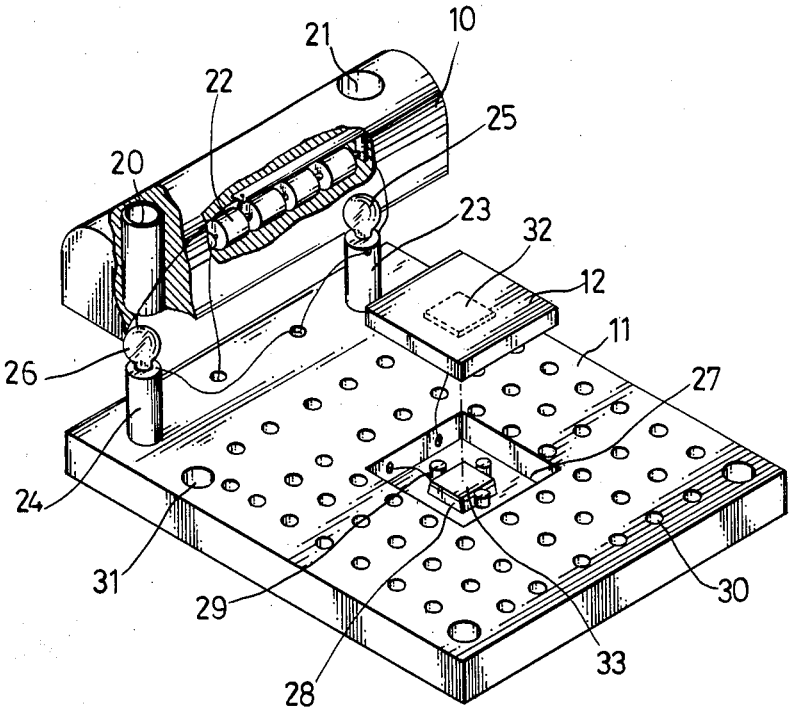
FIG. 2 is an exploded view of the said lamp.

Referring now to the drawings, the nature of this invention is described in detail as follows:

As shown in FIG. 1 and FIG. 2, the mat-type entrance lamp comprises a lamp base 10, a mat member 11 and a switch platform 12. The lamp base 10 and the mat member 11 are made into two integrated parts. The lamp base 10 has two through holes 20, 21 at both ends and a battery room 22 in the middle for four 1.5 voltage batteries. The mat member 11 has two posts 23, 24 in the front with sockets for lamp bulbs 25, 26, a recess 27 with a contact projection 28 and three rubber supports 29 that are a little higher than the projection 28, a number of mud wiping holes 30 all over the top, and four fixing holes 31 in the corners. The switch platform 12 sized to fit in the recess 27 has a contact plate 32 on the bottom side to form a switch with the contact plate 33 on the projection 28 in the recess 27.

It is very easy to install by placing the lamp base 10 on the mat member 11 with the posts 23, 24 fitting in the through holes 20, 21. The battery room 22, lamp bulbs 25, 26 and contact plates 32, 33 are connected with cords to make an electric circuit. Then the whole lamp is placed before the front door or gate.

Figure 3:
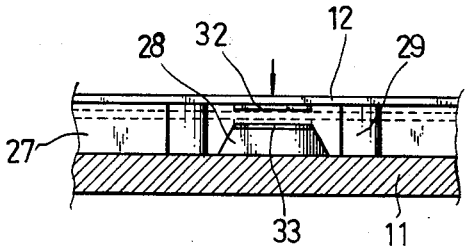
FIG. 3 is a section of the platform-type switch of the said lamp.

As shown in FIG. 3, there is a clearance between the contact plates 32, 33 but when the person who is to open the front door or gate stands on the platform 12 which rests on the rubber supports, it will be lowered to allow the contact plate 32 to touch the contact plate 33 on the projection 28 in the recess 27 and to make an electric circuit. As a result, the lamp produces light to facilitate the unlocking of the door or gate in the dark.

With mud wiping holes, the mat member can be used as a door mat for wiping mud and dirt from the shoes.

Since the time of use is very short the lamp with four 1.5 voltage batteries is very durable, convenient and practical.

What is claimed:

1. A mat-type entrance lamp comprising a lamp base, a mat member and a switch platform; said lamp base attached to one end of said mat member; said lamp base having two through holes and a battery room containing four batteries; said mat member having two posts with bulbs to fit in the through holes of said lamp base; said mat member having a number of mud-wiping holes, a recess with three rubber supports, and a first contact plate lower than the rubber side supports; said switch platform, having a second contact plate on the bottom sized to fit in the recess, and, resting on the rubber supports is spaced above said first contact plate; said battery room, lamp bulbs and contact plates being electrically connected in such a way that when a person stands on the switch platform, it will be lowered to allow the contact plates to close an electrical circuit and cause the lamp to produce light in the dark.

* * * * *